US005150521A

United States Patent [19]

Han

[11] Patent Number: 5,150,521

[45] Date of Patent: Sep. 29, 1992

[54] NAIL COLLECTION BOX FOR A NAIL CLIPPER

[75] Inventor: Kyung Soo Han, Seoul, Rep. of Korea

[73] Assignee: Chi K. Chang, Houston, Tex.

[21] Appl. No.: 834,349

[22] Filed: Feb. 12, 1992

[30] Foreign Application Priority Data

Feb. 12, 1991 [KR] Rep. of Korea ..... 2133/1991[U]

[51] Int. Cl.[5] ..... A45D 29/00; A45D 29.18

[52] U.S. Cl. ..... 30/28; 132/75.5

[58] Field of Search ..... 30/26, 27, 28, 175; 132/75, 75.3, 75.4, 75.5, 76.2, 76.5

[56] References Cited

U.S. PATENT DOCUMENTS

| | | | |
|---|---|---|---|
| 1,809,556 | 6/1931 | Joudon | 132/75.5 |
| 3,855,698 | 12/1974 | Crosby | 132/75.4 |
| 4,602,430 | 7/1986 | Allen, Jr. | 30/28 |
| 4,614,031 | 9/1986 | Chen | 30/28 |
| 4,776,090 | 10/1988 | Grassi | 30/28 |

FOREIGN PATENT DOCUMENTS 906218 7/1990 Rep. of Korea .

*Primary Examiner*—Douglas D. Watts
*Assistant Examiner*—Paul M. Heyrana, Sr.
*Attorney, Agent, or Firm*—Birch, Stewart, Kolasch & Birch

[57] ABSTRACT

A nail collection box for a nail clipper, including a nail collecting portion having a cylindrical configuration includes a handle portion integral with the collecting portion having a hollow space for receiving the body of the nail clipper and an engaging protrusion disposed at the rear end portion thereof to be engaged with a locking hole of the body of the clipper, and a separate concave collector for easily engaging with and disengaged from the collecting portion, whereby the nail collection box can effectively collect clipped nail fragments and prevent the collected nail fragments from scattering.

6 Claims, 1 Drawing Sheet

NAIL COLLECTION BOX FOR A NAIL CLIPPER

BACKGROUND OF THE INVENTION

1. Field of the Invention

The present invention relates to a nail collection box adapted to be releasably coupled with a nail clipper and more particularly, to a container assembled or disassembled with a nail clipper for effectively collecting clipped nail fragments and easily removing the collected nail fragments therefrom.

2. Description of the Prior Art

Several types of clipped nail collectors are well known in the art. One of such prior art collectors discloses a sponge disposed within a space formed between upper and lower cutting jaws of a nail clipper. However, the nail collector cannot effectively collect the clipped nail fragments on the sponge and since the collecting space is generally small, it cannot contain a plenty of clipped nail fragments.

In order to avoid the above mentioned problems, Korean Utility Model Publication No. 90-6,218 issued by the present inventor discloses a nail clipper incorporating with a nail collection box for collecting clipped nail fragments therein. However, the prior art collection box has a number of disadvantages such as, for example, (a) since the prior art collection box contains separate upper and lower bodies, each body being attached to an underside of the nail clipper by means of a bolt is very expensive to manufacture and inconvenient to use.

SUMMARY OF THE INVENTION

Accordingly, it is an object of the present invention to provide a nail collection box which eliminates the above problems encountered in a conventional nail collection box.

Another object of the present invention is to provide a nail collecting box with a nail clipper assembled or disassembled therewith and including a collecting cap disposed therewithin for collecting the clipped nail fragments to prevent them from scattering away and easily removing the collected nail fragments therefrom.

A further object of the present invention is to provide an improved nail collection box which is simple in construction, compact for portability, inexpensive to manufacture, durable in use, and refined in appearance.

Still another object of the present invention is to provide a nail collection box adapted to be releasably coupled with a nail clipper and including a nail collecting portion having a cylindrical configuration, a front opening, at least one bottom opening, and a pair of slits disposed at a pair of side walls of the front opening in line with a gap between upper and lower cutting jaws of the nail clipper, a handle portion integral with the collecting portion and having a hollow interior space for conforming to the exterior configuration of a body of the nail clipper so as to receive the body of the nail clipper and an engaging protrusion disposed at the rear end portion thereof to be engaged with a locking hole of the body of the nail clipper, and a separate concave collector for easily engaging with and disengaging from the collecting portion, whereby the nail collection box can effectively collect clipped nail fragments and prevent the nail fragments from scattering.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a nail collection box for a nail clipper, including a nail collecting portion having a cylindrical configuration, a handle portion integral with the collecting portion having a hollow space for receiving the body of the nail clipper and an engaging protrusion disposed at the rear end portion thereof to be engaged with a locking hole of the body of the clipper, and a separate concave collector for easily engaging with and disengaging from the collecting portion, whereby the nail collection box can effectively collect clipped nail fragments and prevent the collected nail fragments from scattering.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
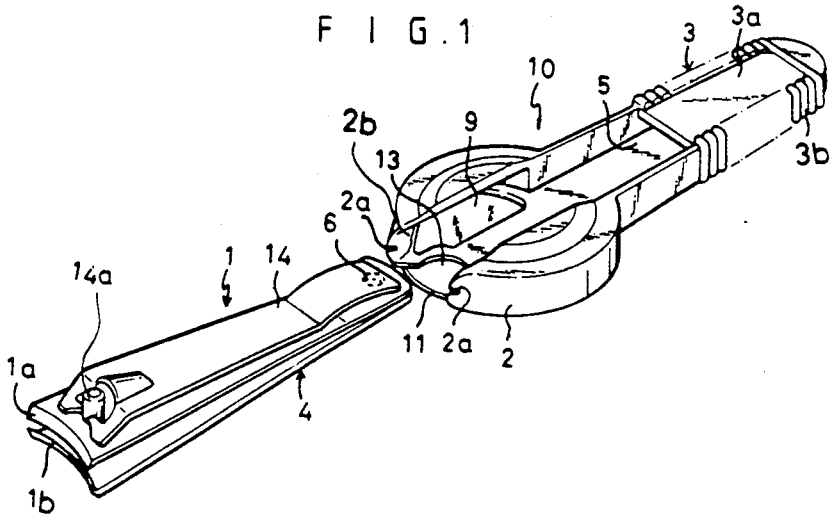
FIG. 1 is an exploded perspective view of the nail collection box according to the present invention showing a nail clipper separated from the nail collection box according to the present invention.
Figure 2:
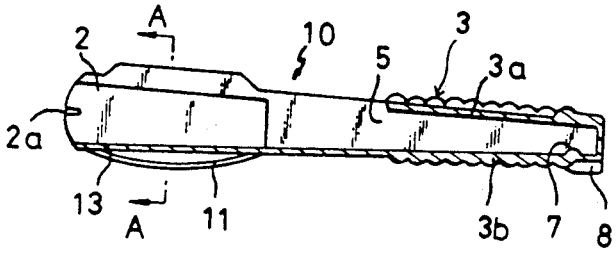
FIG. 2 is a sectional view of the nail collection box of the present invention.
Figure 3:
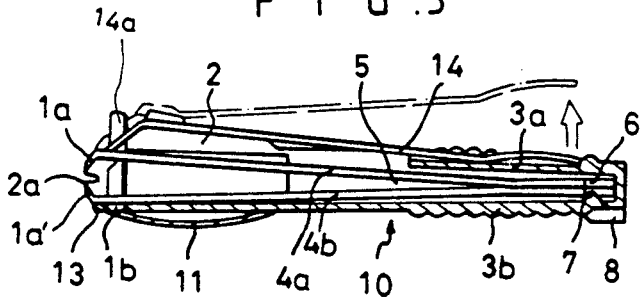
FIG. 3 is a sectional view of the collection box containing the nail clipper assembled therewith.

Referring now in detail to the drawings for the purpose of illustrating preferred embodiments of the present invention, the nail collection box 10 as shown in FIGS. 1, 2, and 3, comprises a nail collecting portion 2 having a cylindrical configuration and a front opening **2*b*, a handle portion 3 defining a box-like structure, and a hollow interior space 5 integrally formed with the collecting portion 2**.

The hollow interior space 5 is configured to conform to the exterior configuration of a body 4 of a nail clipper 1 for slidably receiving the body 4 so that the nail clipper 1 is easily inserted into the hollow interior space 5 through the front opening **2*b* of the collecting portion 2. The body 4 of the nail clipper 1 defines an outer cutting jaw member 4*a* and an inner cutting jaw member 4*b***.

The handle portion 3 further includes a pair of knurled side walls **3*b* and an upper plate surface 3*a*. When the nail clipper 1 is inserted into the nail collection box 10, an acting member 14 of the nail clipper 1 is movably disposed on the upper plate surface 3*a* (FIG. 3). An engaging protrusion 7 is disposed on the rear end portion of the bottom surface of the hollow interior space 5 to be engaged with a locking hole 6 disposed at the rear end portion of the outer cutting jaw member 4*a* of the body 4 of the nail clipper 1** in an assembled state.

The rear end portion of the bottom of the handle portion 3 is provided with a vacancy portion 8 in the vicinity of the engaging protrusion 7 for giving an elasticity to the engaging protrusion 7.

The collecting portion 2 further includes at least one bottom opening 9, a pair of approximately semicircular bottom openings 9 disposed in the bottom thereof for permitting the clipped nail fragments (not shown) to fall downwardly therethrough, and a pair of slits 2*a* disposed in a pair of side walls of the front opening 2*b*, respectively and disposed in line with a gap between upper and lower cutting jaws 1*a* and 1*b* of the nail clipper 1.

Figure 4:
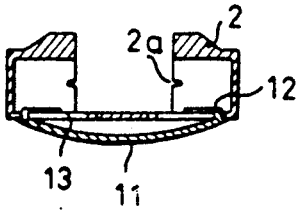
FIG. 4 is cross-sectional view of FIG. 2, taken along line A—A.

The collecting portion 2 further includes a concave collector 11 disposed in the bottom thereof for collecting the clipped nail fragments. The concave collector 11 has a pair of engaging portions 12 which are upwardly projected from its periphery for tightly and releasably engaging with the outer peripheries of the semicircular bottom openings 9 as shown in FIG. 4. A recess 13 is formed in the front bottom of the collecting portion 2 for slidably receiving a projected lower head 14*a* of a support post 14 of the nail clipper 1.

Generally, the configuration of the nail collection box 10 according to the present invention may be modified to conform to the configuration of the used nail clipper 1 to which the nail collection box 10 is applied.

The collection box 10 according to the present invention operates as follows.

The nail clipper 1 first of all is assembled with the collection box 10 in such a manner that the body 4 of the nail clipper 1 is slidably inserted into the hollow interior space 5 of the collection box 10. At this time, the acting member 14 of the nail clipper 1 is slidably disposed on the upper plate surface 3*a* of the handle portion 3.

The engaging protrusion 7 formed on the bottom of the interior space 5 is slidably engaged with the locking hole 6 of the outer cutting jaw member 4*a* of the body 4 of the nail clipper 1, thereby keeping the tight engagement of the nail clipper 1 with the collection box 10. The engagement of the engaging protrusion 7 with the locking hole 6 is facilitated by the elasticity of the engaging protrusion 7 due to the vacancy portion 8 in the vicinity of the engaging protrusion 7.

Thereafter, when the user cuts his nails by the nail clipper 1 assembled with the nail collection box 10 of the present invention, the clipped nail fragments easily fall downwardly and enter into the cylindrical collecting portion 2 of the collection box 10 and then are dropped into the concave collector 11 through the bottom openings 9 of the collecting portion 2. Therefore, the nail fragments (not shown) are completely prevented from scattering away.

Since the handle portion 3 has the knurled side walls 3*b* and the vacancy portion 8 projectively formed at the end of its underside, the nail collection box 10 is steadily grasped so that the user may conveniently operate the nail clipper 1.

Since the slits 2*a* are disposed in the front of the collecting portion 2 in line with the gap between the upper and lower cutting jaws la and lb of the nail clipper 1, the marginal portions of the cutting jaws 1*a* and l*b* can easily operate without any restriction.

After using the nail clipper 1, when it is required to remove the clipped nail fragments accumulated in the collecting portion 2, the user can easily detach the concave collector 11 from the nail collection box 10 by taking out the concave collector by means of hand and then clear out the collecting portion 2. The detached concave collector 11 can be easily reassembled with the collecting portion 2.

Accordingly, the nail collection box 10 of the present invention effectively eliminates the problems encountered in the prior art devices by providing the collection box 10 which has a simple and unitary structure which conforms to the configuration of the conventional nail clipper 1 to which it is applied. Furthermore, the nail collection box 10 is advantageous in that it not only completely prevents the cut nail fragments from flying away but also allows easy removements of the collected nail fragments which makes it very convenient to use.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A nail collection box assembled or disassembled with nail clipper comprising:

a nail collecting portion having a cylindrical configuration, said nail collection box including a front opening, at least one bottom opening, and a pair of slits formed in a pair of side walls of said front opening in line with a gap between upper and lower cutting jaws of said nail clipper, a handle portion extending said collecting portion, said handle portion including a hollow interior space for conforming to the exterior configuration of a body of said nail clipper so as to receive said body and an engaging protrusion disposed at the rear end of the bottom surface thereof for being adapted to engage with a locking hole disposed at the rear end of an outer cutting jaw member of said body of the nail clipper, and a separate concave collector for easily engaging with and disengaging from said collecting portion.

2. The nail collection box of claim 1, wherein said handle portion includes a pair of knurled side walls for tightly grasping the handle portion.

3. The nail collection box of claim 2, wherein said handle portion further includes a vacancy portion disposed at the rear end of the lower surface thereof for giving elasticity to the engaging protrusion and helping in the grasping of the handle portion.

4. The nail collection box of claim 1, wherein said bottom opening is two.

5. The nail collection box of claim 4 said concave collector includes a pair of engaging portions which are upwardly projected from its periphery for tightly and releasably engaging with said bottom openings.

6. The nail collection box of claim 4, wherein said bottom opening has an approximately semicircular configuration.

* * * * *